US005193851A

United States Patent [19]

Honegger

[11] Patent Number: 5,193,851

[45] Date of Patent: Mar. 16, 1993

[54] JOINING PRINTED PARTIAL PRODUCTS TOGETHER

[75] Inventor: Werner Honegger, Tann Rüti, Switzerland

[73] Assignee: Ferag AG, Hinwil, Switzerland

[21] Appl. No.: 853,248

[22] Filed: Mar. 18, 1992

Related U.S. Application Data

[63] Continuation of Ser. No. 537,919, Jun. 13, 1990, Pat. No. 5,137,409.

[30] Foreign Application Priority Data

Jul. 21, 1989 [CH] Switzerland ..... 02732/89

[51] Int. Cl.[5] ..... B42D 1/06

[52] U.S. Cl. ..... 281/15.1; 281/21.1; 281/51

[58] Field of Search ..... 270/53, 55, 57; 281/21.1, 15.1, 51; 412/8, 37

[56] References Cited

U.S. PATENT DOCUMENTS

| | | | |
|---|---|---|---|
| 2,747,865 | 5/1956 | Marshall, Jr. | 270/32 |
| 2,806,443 | 9/1957 | Horn et al. | 412/37 X |
| 4,236,706 | 12/1980 | Schlough | 270/53 |
| 4,489,930 | 12/1984 | Meier | 270/55 |
| 4,500,241 | 2/1985 | Peters et al. | 412/37 |
| 4,641,825 | 2/1987 | Mowry et al. | 270/53 |
| 4,684,116 | 8/1987 | Hänsch | 270/54 |
| 4,684,117 | 8/1987 | Honegger et al. | 270/55 X |
| 4,981,291 | 1/1991 | Honegger et al. | 270/55 |

FOREIGN PATENT DOCUMENTS

| | | | |
|---|---|---|---|
| 0341425 | 4/1989 | European Pat. Off. . | |
| 0390734 | 3/1990 | European Pat. Off. . | |
| 1451056 | 9/1976 | United Kingdom | 412/8 |

*Primary Examiner*—Paul A. Bell
*Attorney, Agent, or Firm*—Walter C. Farley

[57] ABSTRACT

The process makes it possible to gather together and detachably connect two or more partial products (*2a,2b*). The resulting end product can be broken down again into partial products without destroying them. The connection between the partial products is of variable intensity. An apparatus for performing the process has a collecting mechanism (20), a supply (10) for an outer partial product (*2a*) and a supply for an inner partial product (*2b*), an opening station (21), a straightening station (23), a removal station and an adhering station (22), which is connected upstream of the supply point (11) at which the two partial products (*2a,2b*) are brought together, as well as a pressing station (24). The adhering station (22) is connected to an adhesive supply and control unit (35), which makes it possible to adjust the adhesive quantity vary the surface areas and location where adhesive is applied.

2 Claims, 3 Drawing Sheets

JOINING PRINTED PARTIAL PRODUCTS TOGETHER

This application is a continuation of U.S. Ser. No. 07/537,919, filed on Jun. 13, 1990, and now U.S. Pat. No. 5,137,409.

FIELD OF THE INVENTION

The invention is in the field of printing technology and relates to a process and an apparatus for joining together printed partial products and a printed product produced according to the process.

BACKGROUND OF THE INVENTION

Many different processes for joining together printed paper sheets to form an end product are known. In the printing field particular use is made of wire stitching processes, in which folded paper sheets are joined together in the fold by means of staples. Occasionally in a preliminary stage a stitching of partial products take place and in a subsequent process stage they are inserted in an end product and connected thereto.

A two-stage process has proved satisfactory for the binding of top quality books. In a first process stage the printed sheets are combined with one another by thread binding to form a booklet, leaflet or the like and in a second stage several booklets or leaflets are combined in an adhesive binding process. In these binding processes the individual booklets must be juxtaposed, so that the book back is freely accessible for mull lining and back adhesive coating. This process is unsuitable for the production of newspapers and periodicals.

Two-stage binding is also used in the production of printed products in high capacity printing plants. The reasons for a two- or multiple-stage binding are inter alia that partial products are often produced in different partial processes, e.g. on different printing plants or in time-displaced production phases. The partial processes can e.g. be integrated in to a rotary printing process. Unlike in the aforementioned book binding method, in said process the individual booklets are not juxtaposed and are instead inserted in one another. Innovations in the mechanical binding of paper layers became necessary when high capacity printing plants became available, which were able to produce up to 100,000 printed products every hour.

Thus, besides other conventional binding possibilities of late the possibility of adhesive binding has become known, in which the adhesive is injected into the fold of the printed product. The corresponding injection adhesion process is described in Swiss Patent Application 1155/89-3 (corresponding to EP 0390734), whose content is assumed as known for the present application.

However, great significance is still attached to wire stitching. The latter inter alia provides the possibility of integrating the stitching process into the printing process as a result of rotary wire stitchers. Such stitching systems have a high capacity, but are relatively expensive. A booklet or leaflet can have up to about 100 pages. The paper is folded after stitching. In the case of rotary wire stitching the staples are pressed through the spread-out paper piles against an abutment without a locking mechanism. Therefore the stitching is not of high quality. The wire ends can easily project from the paper, which can be disadvantageous during the further processing.

In other applications use can be made of so-called single wire stitching, but this has a lower capacity, i.e. less printed products can be processes per unit of time than in the case of rotary wire stitching. However, the product can have over 300 pages. Single or individual wire stitchers have a stitching abutment with a locking mechanism, but such systems are expensive.

An advantage of wire stitching is that the finished product can be completely opened. There is no closed folding edge covering part of the printed information. However, wire stitching also suffers from significant disadvantages. Apart from the problem of material application through the staples in the back, there are limits to the reliability of wire stitching if it is necessary to produce thick end products with 200 or more pages.

However, conventional adhesive binding, which would fundamentally be suitable for large products and in which the paper layers are bundled, milled and subsequently back-bonded, cannot be used in connection with high capacity printing plants. The reason for this is in particular the long drying time and the associated relatively slow processing rate.

There is nowadays an increasing need, particularly in the production of large end products using high speed processes to gather together prefabricated partial products in an appropriate manner and then bind the same. However, the known processes only offer unsatisfactory possibilities in this connection or are unable to fulfil the requirements as regards quality, speed, flexibility and cost.

However, it is far from simple to solve this problem. The subsequent joining together of already stitched partial products is also problematical in other respects. When joining together stapled booklets with an additional staple there is e.g. a risk of the second staple being impeded by the initial staple on pressing in, so that a reliable connection is not obtained. This problem can admittedly be counteracted by assuring that the two staples are displaced on the back. However, when simultaneously using the same wire stitching device for both binding processes this makes it necessary for adjustments between the processing steps, which leads to technical problems and involves corresponding additional costs. The adjustment is particularly difficult in the case of single wire stitchers having a stitching abutment a locking mechanism. In generalizing, the problem is that the process used for joining together the partial products and the subsequent process of gathering and joining said partial products to the end product must not impede one another. In addition, the combination of wire stitching with conventional adhesive stitching is problematical, because the pressing of the staples through the glued back can be hindered.

It must finally also be borne in mind that a process for joining partial products must be easily integratable in to conventional further processing operations and must not lead to additional problems in the gathering of the partial products, particularly in high speed processes, i.e. where about 100,000 copies have to be produced every hour.

SUMMARY OF THE INVENTION

An object of the present invention is to provide a process and a corresponding apparatus making it possible to join the already prebound partial products to an end product while avoiding the aforementioned disadvantages. The process and apparatus must allow a processing speed of approximately 40,000 copies per hour and higher, as well as providing an inexpensive, reliable binding. A further object of the invention is to provide a process and a corresponding apparatus making it possible to gather and join together in a flexible manner partial products, which, if necessary, should be detachably connectable.

The inventive concept is to join the partial products by means of an adhesive process to form the end product. However, use is not made of a conventional adhesive process with a fold-side roughening but rather the collected partial products are bonded together at the fold back edge or fold inside. Compared with joining by stitching, adhesion offers the possibility of influencing the joining or connecting level, i.e. the strength, which gives the process additional flexibility. The process in particular offers advantages in conjunction with the injection adhesion process.

BRIEF DESCRIPTION OF THE DRAWINGS

The invention is described in greater detail hereinafter, relative to non-limitative embodiments and the attached drawings, wherein.

DESCRIPTION OF THE PREFERRED EMBODIMENTS

The invention more particularly relates to the joining together of prefabricated partial products or partial products simultaneously obtained on different process lines to obtain an end product. The possibility of preparing partial products in early process stages is presently used to a relatively limited extent and the reasons for this were given hereinbefore. It can even be said that often a preliminary, fixed connection of several printed sheets to a partial product is only unwillingly accepted, because difficulties have been encountered in the further processing of these partial products. In conventional processes, to the extent that partial products were in fact bound, generally a stitched partial product was subsequently inserted in another partial product and the two products were then stitched together. Otherwise partial products which were not intended to merely be subsequently loosely inserted were only bound in exceptional cases and only the completely gathered together end products was bound.

The inventive idea is to utilize in a planned manner the possibilities of prefabricated, bound partial products during the further processing. Thus, it is possible to make more flexible conventional possibilities for joining folded sheets or partial products and in addition new end products types can be created. Compared with known processes the occurrence of partial products is not looked upon as a "necessary evil", but instead the partial products form an essential element of the inventive process.

Figure 1:
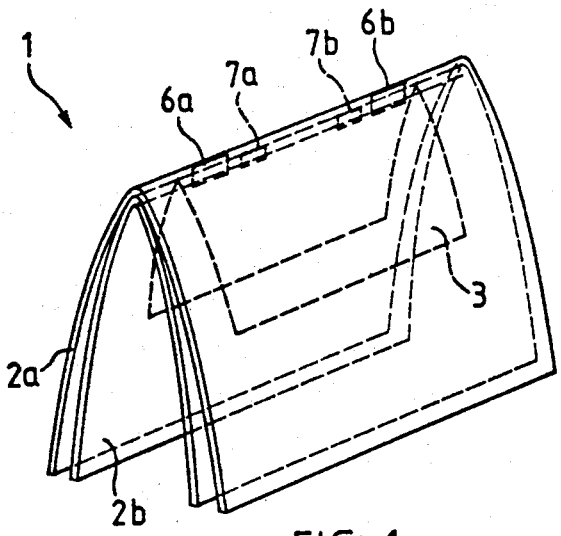
FIG. 1 PRIOR ART
FIG. 1 is a perspective view of a conventionally bound end product with two stitched partial products.

FIG. 1 shows an end product 1 joined in a conventional manner by wire stitching, together with a subsequently inserted, prestitched supplement or insert 3. Apart from the insert 3, the main product comprises several partial products *2a,2b*. As can be gathered from the drawing, staples *6a,6b* which hold together the partial products *2a,2b* and the insert 3, must be inserted in displaced manner with respect to the previously inserted staples *7a,7b*. The insert 3 can only be inserted at the inner fold of the innermost partial product *2a*, if the staples *6a,6b* are to simultaneously connect the insert 3 and all the partial products *2a,2b*. This means that the inter-inserted partial products *2a,2b* must be precisely opened again in the centre prior to inserting the insert. In order to be able to bring this about in a reliable manner, a prefold is required on the partial product. However, stitching means that the partial products and the insert must be placed in precisely defined reciprocal position on a back-gauge in order to allow exact stitching.

Figure 2:
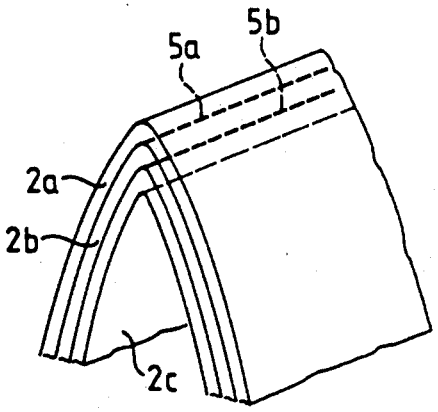
FIG. 2 is a perspective view of an inventively bound end product with three partial product bound by injection adhesion.

FIG. 2 shows an end product produced by a preferred embodiment of the inventive process. Three partial products *2a–2c* are gathered together in such a way that the outer fold of the inner partial products *2b,2c* is located in a corresponding inner fold of another partial product *2a,2b*, i.e a centrally inserted arrangement is obtained. The individual partial products *2a–2c* in this case each comprise several paper layers joined together in a not shown manner. The individual partial products are not stitched together, but are interconnected in the fold by adhesive points *5a,5b*. The adhesive points can be formed by different ways. The adhesive can be applied at a continuous or interrupted strip or in the form of glue spots. The adhesive is e.g. applied to the outer fold and in special cases possibly also to the inner fold of the individual partial products *2b,2c*, which will be explained hereinafter. In a preferred form use is made of partial products, which have paper layers joined together by the injection adhesion process according to U.S. patent application Ser. No. 07/492,532. It must be borne in mind that the terminology used in connection with the arrangement of the partial products only relates to their reciprocal position and not the way in which they are gathered together. Such an arrangement of the partial products to the end product can be brought about by collecting or inserting. The end product has a modular structure, i.e. a printed product of this type, although entirely bound together, can be subsequently easily broken down into its modules, i.e. in to its partial products.

Figure 3:
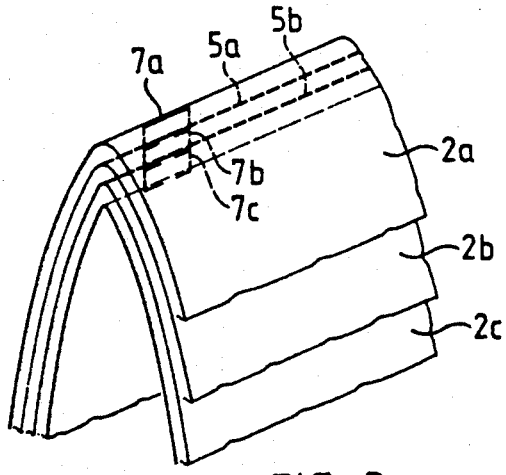
FIG. 3 is a perspective view of an inventively bound end product with three stitched partial products.

FIG. 3 shows another use example, in which each of the individual partial products *2a–2c* is stitched together. Also in conjunction with partial products stitched in this way, the inventive process has various advantages. Once again the partial product *2a–2c* are interconnected by adhesive points *5a,5b*. No attention need be paid to the position of the staples *7a–7c* when collecting together the partial products. As shown, they can e.g. be superimposed. A displacement of the individual staples in the direction of the fold does not influence the connection or joining to form the end product. Even in the case of a considerable displacement of the staples, unlike in the case of conventional final stitching, there is no collision between the staples 7a–7c with in this case, a superfluous joint staple. Thus, there is no problem of a precise positioning in the direction of the fold prior to joining. The partial products can be inserted in one another or collected in an approximate reciprocal alignment and subsequently cut on two or three sides.

Figure 4:
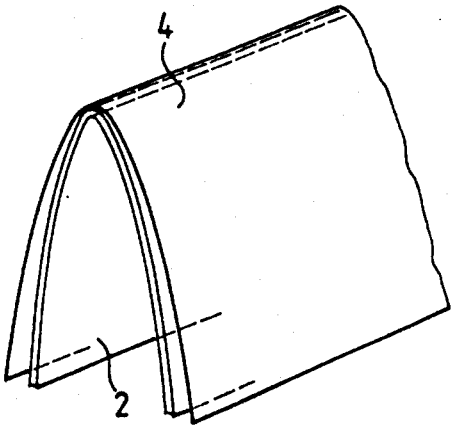
FIG. 4 is a perspective view of an end product with a cover or wrapper and a partial product bound by injection adhesion.

Another use of the process is shown in FIG. 4. A partial product 2, which can in turn consist of several inventively bound partial products, is to be subsequently surrounded by a cover or wrapper 4. The cover can e.g. consist of a firmer paper than that used for the partial products or can be made from a different material. Compared with a conventional stitching, the cover is not only connected by means of two clips to the inner part in the vicinity of the fold, but is instead connected over the entire length and at several points to the partial product 2. Particularly in the case of covers made from a firmer or stronger material and comprehensive inner parts, conventional stitching suffered from the disadvantage that there was a tearing risk at the normally two stitching point. This makes it clear that not only can partial products be connected together, but that the process also offers advantages if individual printed sheets are to be connected to partial products.

An important advantage of the inventive process is the possibility of bringing about a "variable intensity" connection of the partial products. In conventional processes, e.g. wire stitching, the printed sheets or two or more partial products could only be firmly interconnected or then loosely inserted in one another or collected. However, the present process permits a connection, which can vary in continuous manner from a strong to an only slight connection. This e.g. makes it possible to easily detachably connect one partial product to another and the corresponding partial product can easily be released from the end product. The partial products are not damaged or destroyed during removal. There is no need to open staples and the like. This e.g. makes it possible to detach in undamaged form a regular supplement to the periodical, e.g. a television program schedule. Another important advantage is that e.g. several newspaper bands can be joined together, but, if necessary, individual bands can be detached or the end product can be broken down into parts. The modular structure of the end product with the controllable intensity of the connection of the individual partial products can be realized in several different variants.

Thus, inventive process extends the hitherto known connection possibilities within the industrial further processing of printed products and creates new possibilities, or allows additional degrees of freedom in connection with joining to form the end product. The novel concept and its possibilities are illustrated by the following table.

| | Conventional Process | Invention |
|---|---|---|
| Size of partial products | 1–100 pages | 1–100 pages |
| Size of end products | 1–300 pages | basically unlimited |
| Number of partial products | only one prestitched and subsequently stitched in partial product | number of pre-connected partial products variable |
| Connection intensity | fixed/none | continuously variable from strong to easily detachable |
| Positioning in fold direction | fundamentally necessary | fundamentally unnecessary |
| Insertion possibilities | only central insertion | insertion and connection possible at different points |

It must be borne in mind that the partial products according to the invention fundamentally, but not exclusively, consist of interconnected printed sheets. The inventive process extends the possibility of binding in high speed processes within the scope of the further processing of printed products in numerous different ways. End product types can be characterized by different features, such as e.g. the end product size, the size and number of the partial products, etc. In a specific process, e.g. wire stitching or adhesive binding, only specific features of the end product can be varied and the latter can only be varied in specific ranges. Thus, it is not e.g. possible with conventional processes using wire stitching to obtain an end product with approximately 300 pages at a high process speed. The advantage of the novel process is that end product types with new features can be provided and these can be varied within wide ranges. The fundamentally available options can be used alone or in combination, so that this brings about the sought flexibility of the process.

The process is particularly suitable for joining prefolded partial products, e.g. tabloids, because then the inner partial product is readily accessible at its fold out side. The possibility of interconnecting already prebound partial products in a simple manner and at a subsequent stage makes it possible to inexpensively produce very comprehensive end products. Unlike in the case of known processes, the inventive process does not aim at holding together the partial products by a connection common to all of them, e.g. by means of two staples passing through all the partial products, but instead only one connection is needed between two partial products, i.e. the end product is modular.

Figure 5:
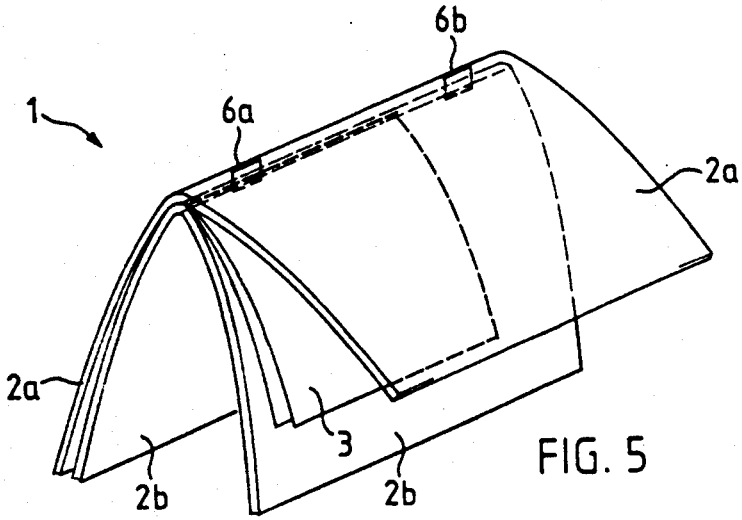
FIG. 5 is a perspective view of an end product with a stitched partial product into which is bonded at a random point a partial product bound by injection adhesion.

FIG. 5 illustrates a further novel possibility of the process. A main product 1 here contains two partial products 2a,2b, as well as an insert 3. In this example the two partial products 2a,2b are stitched together by means of staples 6a,6b. Unlike in the example according to FIG. 1, the insert 3 is not centrally inserted and is instead inserted at a random point of the outer partial product 2a, i.e. is inserted in centrally displaced manner.

The possibility of a modular construction of the main product in conjunction with the variable intensity of the connections between in each case two partial products offers important advantages. The process advantages can be utilized when producing the printed products. It is made much easier to prepare individual partial products, store them and only join them to the end product at a later stage. This new type of modular end product can be obtained in a simple inexpensive manner.

Figure 6:
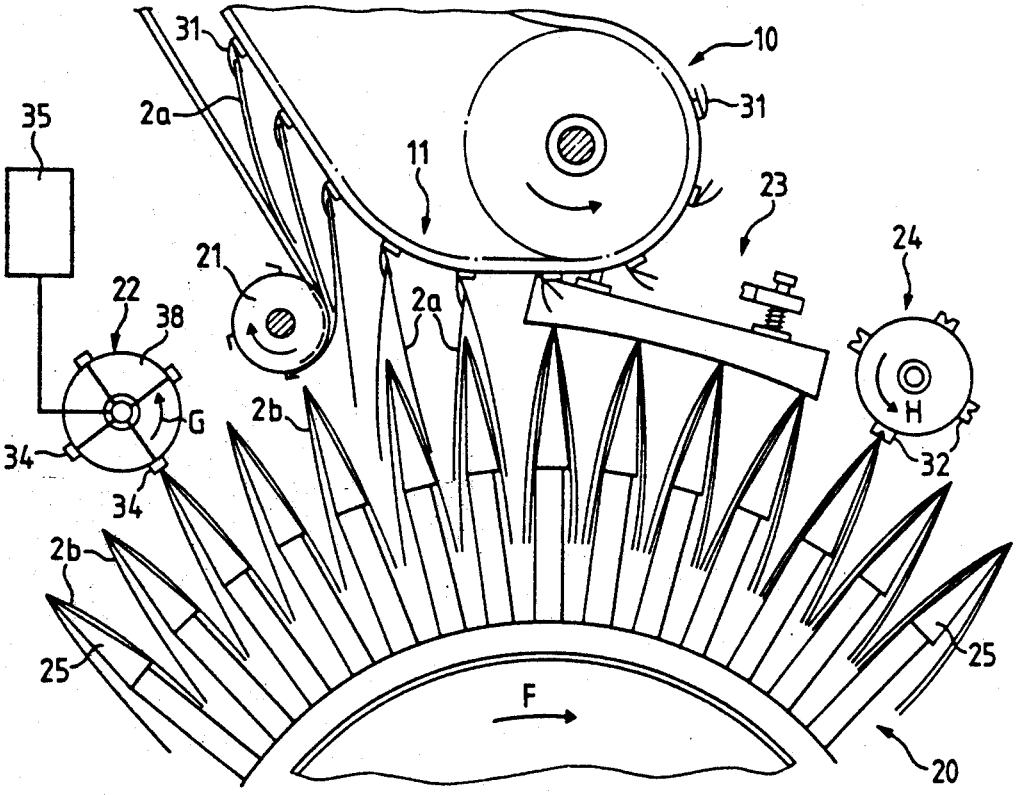
FIG. 6 is a partial side elevation of an embodiment of an apparatus according to the invention.

FIG. 6 shows an embodiment of an apparatus according to the invention. From a feed or supply means 10 the outer partial products 2a are fed or supplied to a collecting means 20. In known manner said outer partial products 2a are held e.g. by means of conveying clips 31. The collecting means is formed in the present example by a drum rotating in the direction of arrow F and which has on its periphery a plurality of radially directed collecting supports 25. Such collecting means and supply means belong to the prior art and possible variants are e g. described in U.S. Pat. Nos. 4,489,930 and 4,684,116.

Each of the collecting supports 25 already carries an inner partial product 2b, which is supplied to the collecting supports in a not shown manner at another point and which is conventionally displaced in the axial direction of the drum. The drawing also shows an opening station 21, an adhering station 22, a straightening station 23 and a pressing station 24. The gathering and connecting of the partial products 2a,2b takes place in a multiphase process. The adhering station is used for applying adhesive points to the inner partial products 2b at the fold. The adhesive is supplied by an adhesive supply and control unit 35 of the adhering station. At right angles to the conveying direction F it has arrays 34 with a plurality of controllable valves, which are used for transferring the adhesive to the fold backs of the inner partial products. It is possible to apply the adhesive to the entire fold or to only areas 5 thereof. The thus prepared partial product 2b are conveyed on in conveying direction F. At an opening station 21 the outer partial products 2a conveyed by means of the supply means 10 are centrally opened and at a supply point 11 are brought over the partial products 2b, also over the collecting supports 25. Once the conveying clips have released the outer partial products 2a, the latter come to rest with their fold inside on the glued fold of the inner partial products 2b. The engaging partial products 2a,2b are then supplied to the straightening station, which brings about a reciprocal alignment in the fold direction. The aligned partial products 2a,2b then pass through a pressing station, in which the pressing element 32 press against the fold. The collecting supports 25 offer a corresponding resistance, so that the adhesive point between the two partial products is firmly pressed and consequently said products are joined to the end product. Subsequently the end product is removed in known manner at a removal station.

As is apparent, the time sequence of the corresponding process stations must be so adapted that the setting time of the adhesive is taken into account or utilized in an optimum manner. The adhesive must not have set between the adhering station 22 and the straightening station 23, so that it is still possible to reciprocally align the partial products. The adhesive must almost have set at the pressing station 24, so that there is a fixed joining of the partial products after the pressing station. Account can be taken of this need to respect the setting time by arranging the individual process stations and/or by choosing the adhesive in an appropriate manner. The interconnected partial products 2a,2b can already form the end product or can serve as a partial product for further processing. Obviously and in a corresponding manner, following the pressing station further partial products can be correspondingly joined to said partial products 2a,2b.

Figure 8:
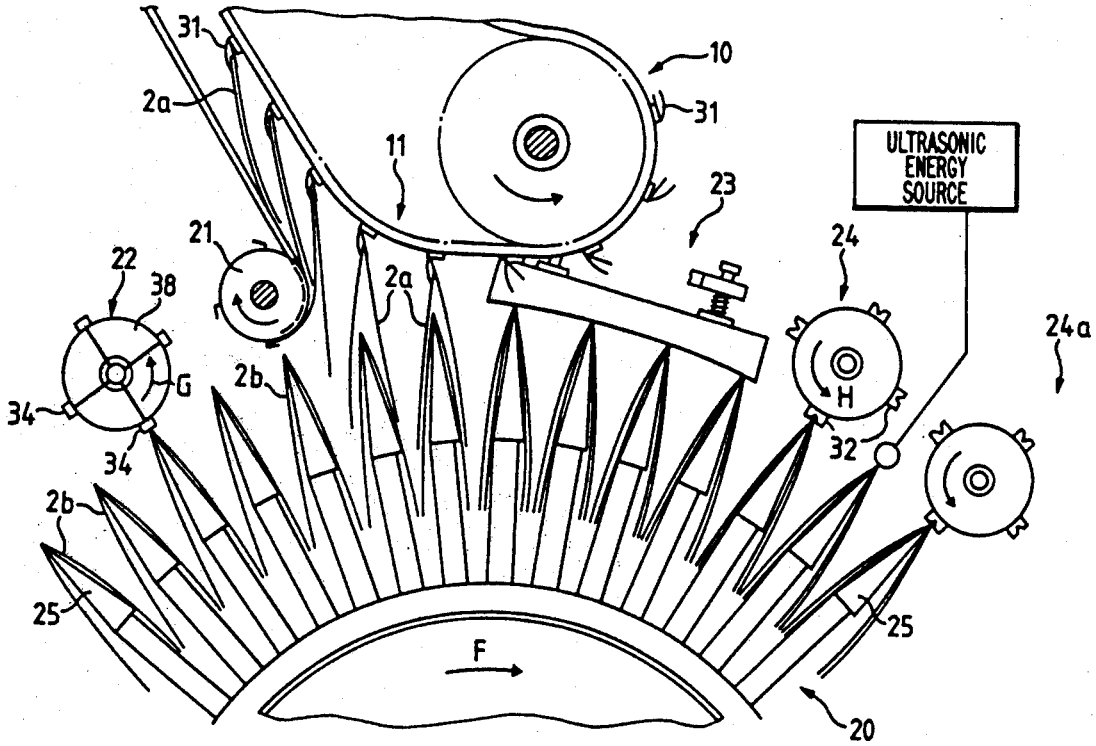
FIG. 8 is a partial side elevation of a further embodiment of an apparatus in accordance with the invention.

The application of the adhesive or the gluing of the fold of the inner partial products 2b can take place in numerous different ways. As a function of the desired strength of the connection, it is possible to vary the nature of the adhesive, its quantity or the number and position of adhesive points. In order to be able to speed up setting in specific uses, additional measures can be taken. Preferably use is made of ultrasonic action, such as described in the aforementioned Swiss Patent Application 1155/89-3. Ultrasonic application can take place either between the adhering station 22 and the pressing station 24 and/or following the pressing station 24 as shown in FIG. 8. An ultrasonic transducer 40 contacts the fold and is supplied with energy from an ultrasonic energy source 42. However, it is also possible to take other measures, such as e.g. the supply of hot air. Although reference is regularly made herein to adhesives, it must be borne in mind that other joining or connecting materials are suitable, which would not be covered by the narrow concept of an "adhesive". All that is important is that the joining material brought between the two partial products in the vicinity of the fold, has a joining capacity. The viscosity and setting characteristics of the adhesive or the joining material are preferably also taken into account with a view to the coordination of the individual process steps between adhesive application and pressing. thixotropic joining materials are suitable for the process. In the presently described embodiment use is made of an adhesive, whose setting characteristics are aided by pressure action at the pressing station 24. When using other joining materials use is correspondingly made of other devices, which influence the setting or solidifying of said materials.

Figure 7:
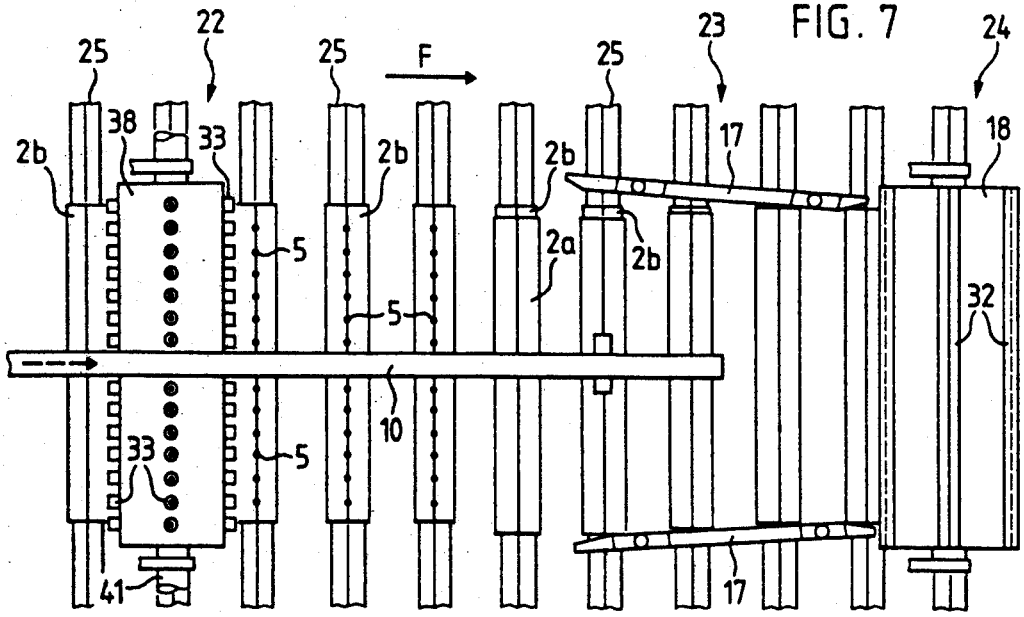
FIG. 7 is a developed view of the conveying section between the adhesion pressing stations.

FIG. 7 shows the cooperation of the process steps between the adhering station 22 and the pressing station 24 in greater detail. It diagrammatically shows a developed view of the conveying or processing section of FIG. 6. The outer partial products 2a are supplied by supply means 10 and the inner partial products 2b are supplied to the collecting support 25. The adhering station 22 has a plurality of adhesive transfer points 33, which can be constructed as regulatable or controllable dispensing valves or nozzles. The adhesive is supplied to the adhesive transfer points 33 by the adhesive supply means 35 (FIG. 6). In turn, the adhesive transfer points are arranged at right angles to conveying direction F on a rotating roller 3 in four linear groups or arrays 34 (cf. FIG. 6). The roller 38 rotates about an axis 41 in the direction of arrow G. The rotary speed of the roller 38 is synchronously coupled with the conveying speed of the partial product 2b in direction F. Thus, the four adhesive transfer arrays 34 successively come into contact with the fold of the traversing partial products 2b. Following the adhering station 22 the fold outside of the partial products is provided with adhesive points 4.

Figure 9:
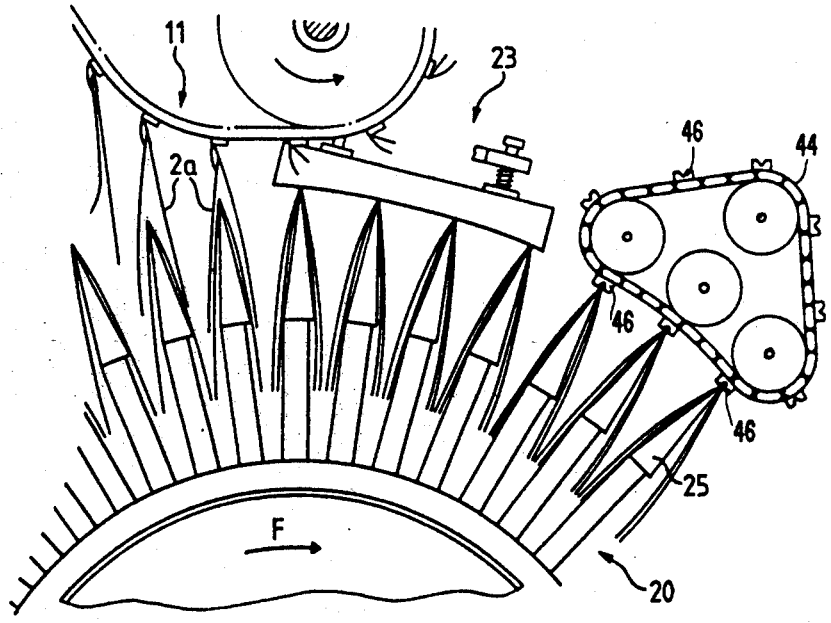
FIG. 9 is a similar view of yet another embodiment of an apparatus in accordance with the invention.

The individual adhesive transfer points can be controlled or regulated at random. The adhesive supply means 35 can simultaneously form the control unit, in that the supplied adhesive quantity for each transfer point is dosed or metered. It is obviously also possible to provide a separate control, e.g. a computer-controlled device, which directly controls the arrays 34 or the individual transfer points 33. As a function of the controlling of the adhesive transfer arrays, the adhesive is transferred to all the adhesive transfer points 33, or only individual points are activated. Thus, by dosing the adhesive quantity and the choice of the number and position of adhesive points, it is possible to influence the strength of the connection between the partial products 2a,2b. In the straightening station 23, which is e.g. formed by two guide elements 17, the partial products 2a,2b are aligned in the direction of the fold, which is here at right angles to the conveying direction F. The adhesive which, in the vicinity of the straightening station has not yet set, permits a reciprocal displacement of the two partial products. The two partial products 2a,2b are pressed against one another in the vicinity of pressing station 24. This takes place by means of a pressing roller 18 provided with pressing elements and whose circumferential speed is also synchronously coupled with the conveying speed of the partial products. In order to be able to increase the total contact pressure action time, it is possible to successively arrange several pressing rollers or stations 24,24a as shown in FIG. 8. A good pressing action can also be obtained by a rotary pressing member, e.g. chain elements 44, (FIG. 9) which are pressed by links 46 against the fold backs of the partial products 2a,2b to be connected.

As can be gathered from FIG. 6, the corresponding rotary movements G or H of the roller 38 and the pressing roller 18 are set in such a way that the adhesive transfer arrays 34 and the pressing elements 32 rotate with the conveyed printed products.

In place of a collecting, it is also possible to insert the partial products. It must then be borne in mind that when inserting no glue residue are transferred at undesired points from one partial product to the other.

I claim:

1. A printed product comprising a plurality of partial printed products, each said partial printed product including a plurality of folded pages each having a fold and each but one having a first adhesive along an outer surface of said fold, said folded pages being assembled one within the next and adhered together at the folds to form the partial printed product with said one page being outermost on said partial printed product one of said partial printed products being identified as an outer partial printed product, and each said partial printed product except said outer partial printed product further having a second adhesive along an outer surface of an outermost page of said partial printed product, said partial printed products being assembled one within the next with said outer partial printed product on the outside of the others to form the final printed product.

2. A printed product according to claim 1 wherein said second adhesive is a detachable adhesive to permit selective detachment of said partial printed products from each other.

* * * * *